US006102373A

United States Patent [19]

Amsinger

[11] Patent Number: 6,102,373

[45] Date of Patent: Aug. 15, 2000

[54] CRANE SWING WARNING SYSTEM

[76] Inventor: Gary James Amsinger, 9 Pine Cliff Ct., Defiance, Mo. 63341

[21] Appl. No.: 09/019,415

[22] Filed: Feb. 5, 1998

[51] Int. Cl.[7] ..... B66C 15/00

[52] U.S. Cl. ..... 256/1; 256/23; 212/276; 212/280

[58] Field of Search ..... 256/1, DIG. 6, 256/40, 42, 23; 212/280, 276; 248/345.1, 206.5; 403/378, 379.1, 379.2, 379.3, 379.4, 379.5

[56] References Cited

U.S. PATENT DOCUMENTS

| | | | |
|---|---|---|---|
| 3,256,998 | 6/1966 | LaHarty | 212/280 X |
| 3,812,978 | 5/1974 | Roland et al. | 256/1 X |
| 4,434,901 | 3/1984 | Gehl | 212/276 |
| 4,524,953 | 6/1985 | Phillips et al. | 256/23 |
| 5,287,869 | 2/1994 | Wu | 403/378 X |
| 5,515,655 | 5/1996 | Hoffman | 403/379.3 X |
| 5,630,517 | 5/1997 | Maznik | 248/206.5 X |
| 5,649,690 | 7/1997 | Kilmer | 256/40 X |
| 5,746,329 | 5/1998 | Rondeau | 246/206.5 X |

*Primary Examiner*—Lynne H. Browne
*Assistant Examiner*—John R. Cottingham

[57] ABSTRACT

Crane swing warning system is disclosed for a crane that has an undercarriage, which is independent from its cab body, connected by a turntable that the upper crane body rotates about on a vertical axis. The crane swing warning system consists of a continuous plastic caution tape extended out and around the upper crane body by supports adjustable in 360 degrees, and in length, fully retractable or completely removed. This crane swing warning system is to warn individuals of the movement of the upper crane body as to prevent the individuals from being struck by or being caught between the rotating upper crane body and the crane undercarriage.

2 Claims, 5 Drawing Sheets

CRANE SWING WARNING SYSTEM

BACKGROUND OF THE INVENTION

Federal Regulations require that accessible areas within the swing radius of the rear of the rotating superstructure of the upper crane body shall be barricaded in such a manner as to prevent an employee from being struck or crushed by the crane. These regulations are specifically referenced in Title 29 CFR 1915.(d), OSHA standards for shipyard employment; Title 29 CFR 1917.45(h)(1)(2), OSHA standards for marine terminals; Title 29 CFR 1918.55 and 1918.(a)(d), OSHA standards for longshoring; and Title 29 CFR 1926.550(a)(9), OSHA standards for the construction industry.

These regulations pose several distinct compliance problems for an employer. On a mobile crane, such as those used in construction, their position is not always static, in some instances it will travel or move even during the operation of hoisting. It most certainly moves from one area of a construction project to another quite frequently to perform its main objective of hoisting material to its proper location. This makes the use of stationary barricade systems, which are set up around the perimeter of the crane on the ground, ineffective as well as cost prohibitive. Previous designs of protection attempt to affix a permanent apparatus to the crane undercarriage and or upper crane body, which extend outward past the swing radius. These methods require specific construction and attachment details, for each type of apparatus, which would be different for each specific crane model or make. This would require large expenditures in design, construction, and installation for each make of crane protected. To further this problem many times cranes are rented or leased from a third party and the leasee is prohibited from physically altering or attaching permanent fixtures that may damage the crane itself, i.e. Welding, drilling and bolting. Additional cost and time are also associated with removing the apparatus prior to returning the crane to the owner and repairing the damage, or the cost associated with removing and reinstalling when transporting a piece of owned equipment.

These past attempts represent a hazard in themselves, as they are typically a fixed pole or other support that will move with the upper crane body with the possibility of striking or impaling an individual.

The crane swing warning system invention as described herein provides a safe, lightweight, portable, and cost-effective method to comply with the Federal Regulations mentioned and more importantly warn individuals against danger. It is not intended to physically barricade anyone from getting to the piece of equipment, as this is almost impossible and is economically prohibitive.

The inventive crane swing warning system has been reviewed by the Director of the Office of Construction and Maritime Compliance Assistance, U.S. Department of Labor, Occupational Safety and Health Administration, and found to quote "meet Federal OSHA's requirements for barricading the swing radius of a crane's superstructure."

SUMMARY OF THE INVENTION

The crane swing warning system is based on highly visible multi-positional retractable arms, supported by a magnetic base. The retractable arms can be adjusted in any plane by a locking angle bracket, and support a common inexpensive, and disposable caution tape from the furthermost end which is dispensed from a storage reel at the base of the arm. The retractable arms are positioned to allow the caution tape to completely surround the rotating superstructure of the upper crane body making all those individuals in the immediate area aware of the dangerous condition of being caught within the swing radius of the rotating superstructure and stationary undercarriage. The ends of the retractable arms are designed to be pliable as not to impale an individual if struck by same. The retractable arms are two part and adjustable in length by sliding the outer length inside the base section. The retractable arm has a locking angle joint close to the base, where the arm attaches to the crane, permitting adjustment in any plane, thus allowing it to fit the specific dimensions of any piece of equipment. The magnetic base permits the retractable arms to be mounted at any metallic location on the crane, producing the most efficient positioning and optimizing the caution tape configuration. The magnetic base eliminates the need to mechanically attach or physically alter the crane by welding, drilling, cutting or other means of attachment that could be prohibited by the crane's owner. It eliminates the need for multiple attachment designs and hardware for different makes or models and allows the invention to be used on any type crane, with no alterations to its attachment. The magnetic base favors ease of installation and removal, which lends itself to immediate use and installation by a single individual, without the use of tools. The crane swing warning system invention permits easy transportation from one location to another, by fully retracting and stowing the arms parallel to the crane body while still attached, and is cost effective. The magnetic base will break away, or detach should a force strong enough be applied, as in striking a fixed object or a person. This makes it safer than a rigid pole attached to a crane in a permanent manner, similar to previous inventions, as it eliminates impalement hazards. This breakaway feature also eliminates the need for a costly repair, the system can just be reattached by touching it to the crane should it become dislodged, eliminates downtime, and more importantly helps to avoid the scenario where the safety device is not reattached and the crane is used while individuals within close proximity to the crane are exposed to a hazard.

BEST MODE FOR CARRYING OUT THE INVENTION

The following is a description of the inventive crane swing warning system, wherein like numerals refer to like parts throughout.

As can be observed in FIG.'S 1, 2, and 3 the inventive crane swing warning system (which is composed of four each of the crane swing warning devices) establishes a highly visible perimeter caution system around the crane's swing radius. It uses warning tape 31, a lightweight plastic ribbon, supported in spaced relation, by four each of the inventive crane swing warning devices 16, which all move in concert with the upper crane body 12. It may be observed in these figures, referenced above, that each of the inventive crane swing warning devices 16 are constructed identically to one another.

Figure 1:
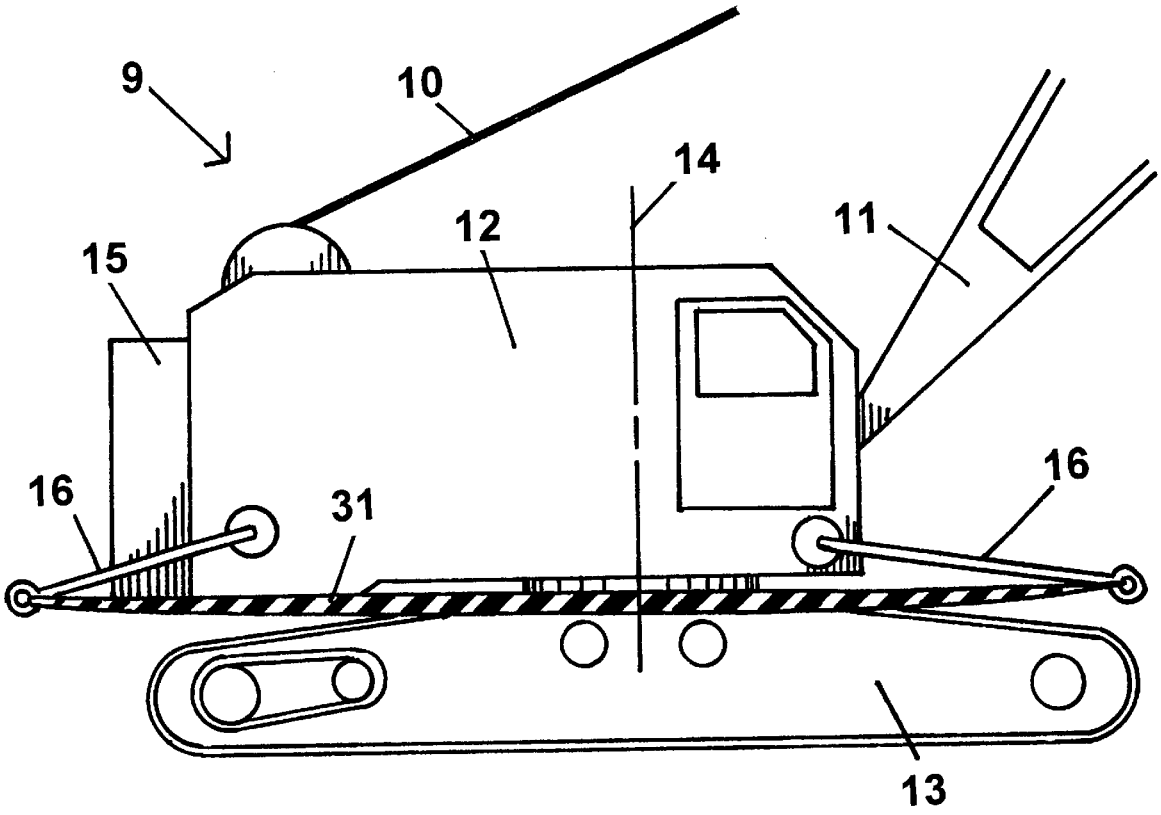
FIG. 1 is a fragmentary side elevation view of a hydraulically operated crane to which the crane swing warning system is attached. It is depicted in a protective warning configuration. The figure illustrates the typical positioning of two of the inventive crane swing warning system arms, of which a typical installation would consist of four.
Figure 2:
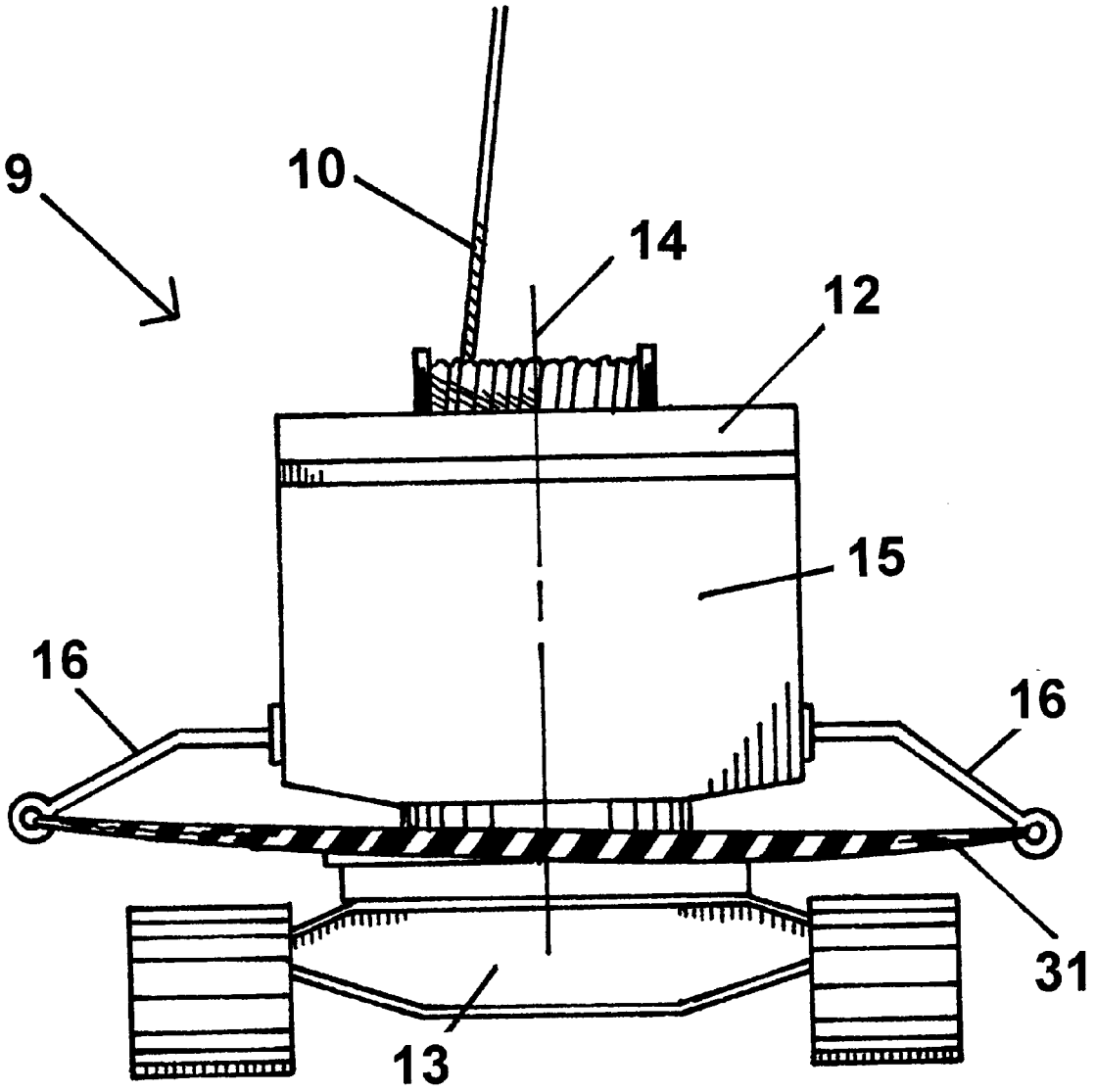
FIG. 2 is a fragmentary rear elevation view of the same crane as in FIG. 1, depicting the inventive crane swing warning system attached and representing the position of two of the retratable arms.

Attention is directed to FIG. 1, a crane generally represented by the number 9. The crane is a machine which can both lift objects and move them horizontally by use of a cable 10, supported and directed by a lattice, or similar manufacture, boom, number 11. The upper crane body 12 is mounted to the under carriage 13 by a turntable, which the upper crane body 12 rotates around, on a substantially vertical axis 14. This rotation allows the crane boom 11, and its supported cable 10, to rotate 360 degrees in order to move objects from one location to another. The weights of the boom 11 and the object being lifted, or moved, are offset, or countered, by placing the heavy hoisting machinery and a counter weight 15 opposite the boom 11 a substantial distance from the center of rotation 14. This action of rotating around the turntable and the center of rotation causes the counterweight 15 end of the upper crane body to protrude or extend past the undercarriage 13, substantially, so that a person could possibly be struck by same or caught between the counter weight 15, or the upper crane body, and the under carriage 13.

Figure 3:
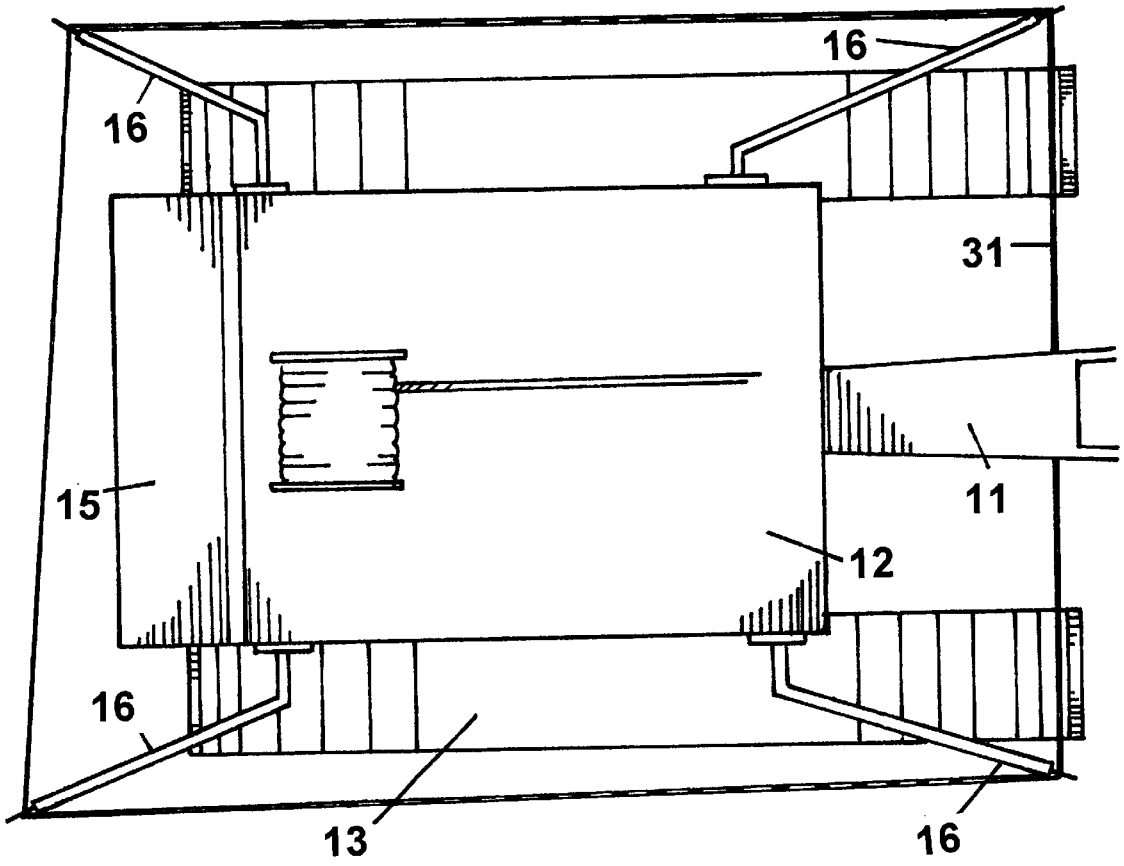
FIG. 3 is a fragmentary top plan view of the same crane as depicted in FIGS. 1 and 2. This figure illustrates a typical configuration of the crane swing warning system consisting of four retractable arms, attached to the crane's upper body by the magnetic base, and supporting caution tape from their furthermost end, substantially around the rotating superstructure of the upper crane body.
Figure 4:
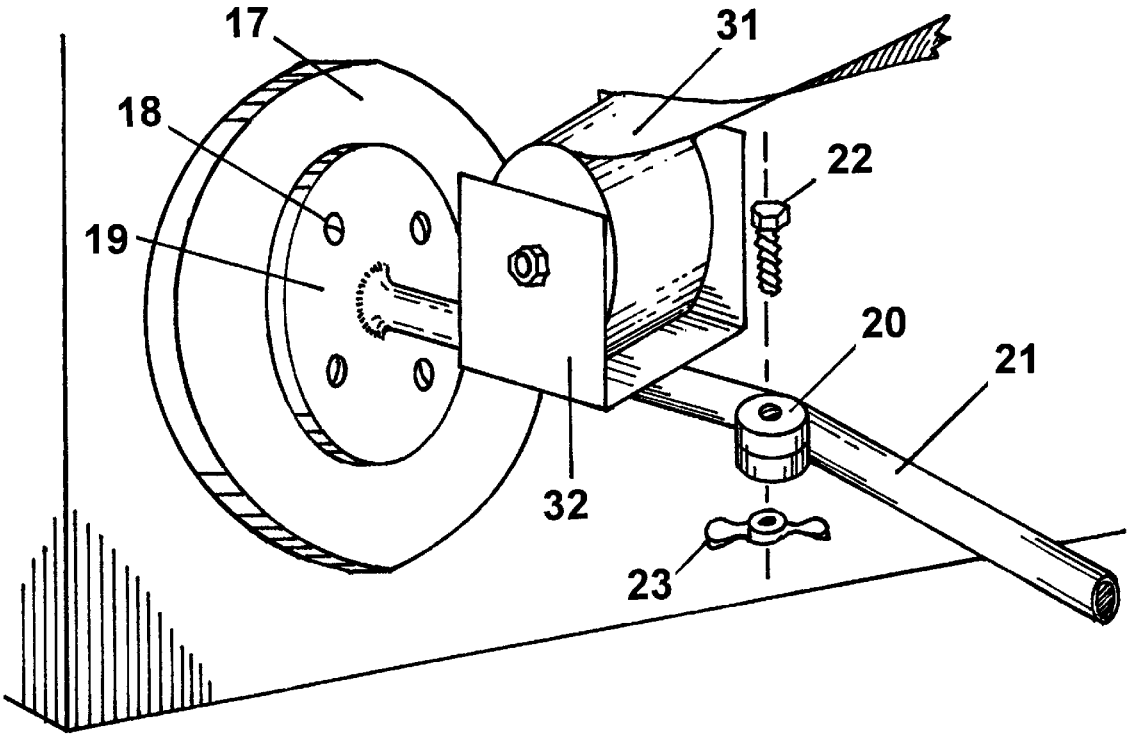
FIG. 4 is an enlarged fragmentary perspective view illustrating the inventive crane swing warning system's attachment to the upper crane body and how the retractable arms are supported from the upper crane body. The figure shows, in particular, the magnetic base, tape dispenser, and fragmentary portion of the retractable arm with inclusion of the locking angle bracket.
Figure 5:
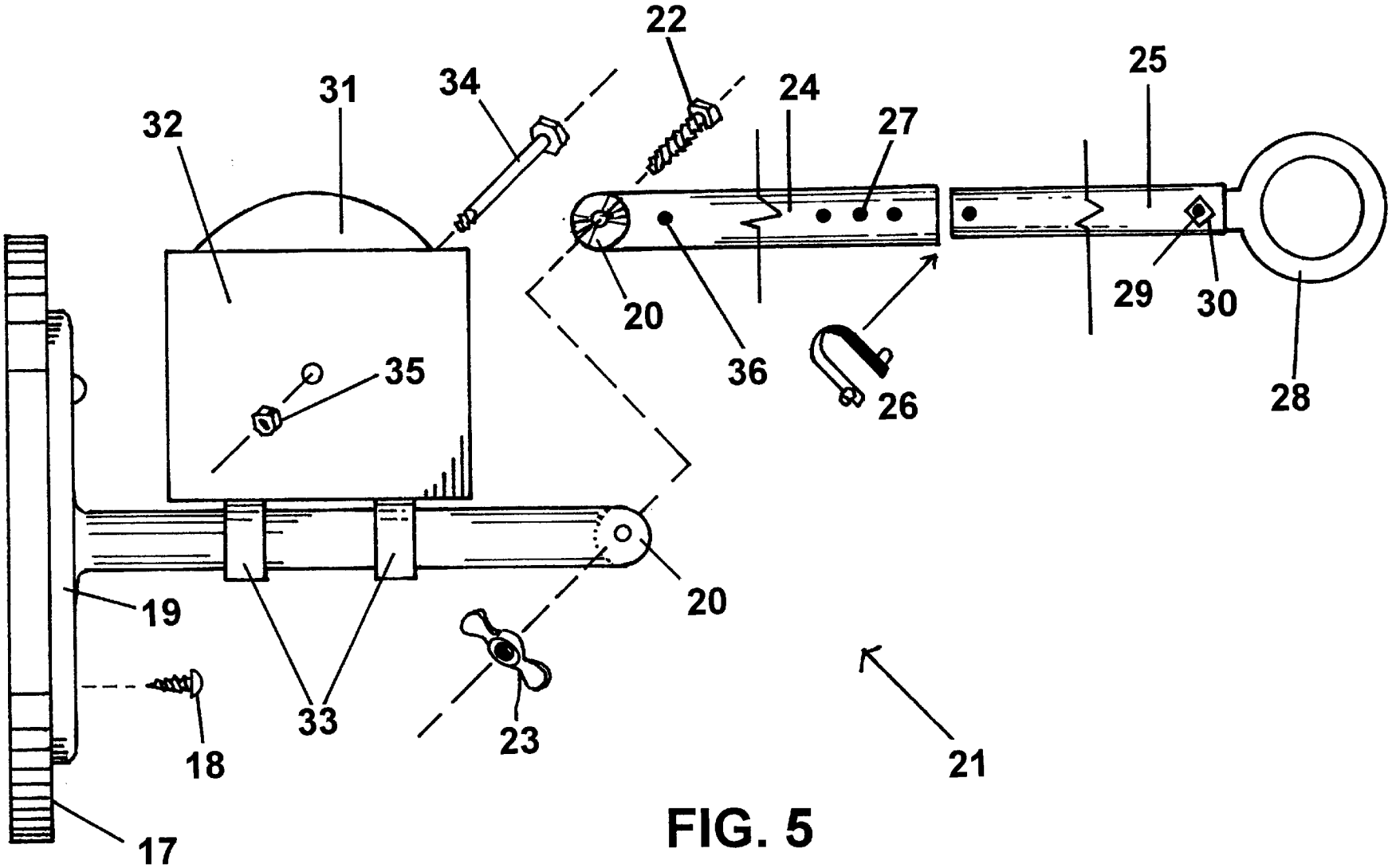
FIG. 5 is a fragmentary side plan view of the inventive crane swing warning system. The typical installation would, as shown in FIG. 4, include four each of the inventive apparatuses as depicted in this figure, in addition to the caution tape supported from the further most ends of same. This figure illustrates all parts, magnetic base, tape dispenser, locking angle bracket, and retractable arms.

As can be seen most clearly in FIG. 3, the overhead view, the inventive crane swing warning device is in its common configuration with 4 each of the retractable arms 16. The device can be positioned to any configuration to most effectively support caution tape 31 at a given distance from the crane 9 in order to warn individuals of the eminent danger from the upper crane body 12 rotating about the vertical axis 14. The inventive crane swing warning system device 16 is attached to the upper crane body 12, as depicted most clearly in the perspective view of FIG. 4, with a magnetic base 17. The magnetic base 17 is attached by threaded bolts 18, to the projection leg 19 consisting of a flared base end, for structural integrity, that transitions into a tubular shape. At the far end of the projection leg 19, opposite its flared base, is one half of the locking angle bracket 20. The other half of the locking angle bracket 20 is formed by the base end of the retractable arm, generally represented by 21. The two halves of the locking angle bracket 20 are connected with a threaded bolt secured with a threaded wing nut 23 so that the locking angle bracket 20 can be adjusted and locked into multiple positions. The locking angle bracket 20 allows the retractable arm 21 to be rotated and locked in a plane perpendicular to the magnetic base 17 and for aproximatly 180 degrees within that plane. In addition the magnetic base 17 can be rotated 360 degrees when attached to the upper crane body 12, allowing the retractable arm 21 to be positioned in any plane or angle, affording almost limitless adjustability. The retractable arm, generally represented by 21, is constructed of a projection leg 19, a tubular base section 24 and an extendible section 25, most clearly depicted in FIG. 5. The extendible section 25 is telescopically engaged to the tubular base section 24 by a spring button assembly 26 which is inserted in the interior of the extendible section 25 in the first inserted end into the tubular base section 24, and aligned with a series of holes 27 radially opposite, and of equal diameter, that are in both the extendible section 25 and tubular base section 24, at the end into which the adjacent end of the extendible section 25 is telescoped. There are multiple sets of these holes 27 to allow for the extendible section 25 to be extended at numerous lengths. There is also one set of radially opposite holes 36 at the base of the tubular base section 24 that when the extendible section 25 is in its fully retracted position will receive the spring button assembly 26 thus locking same in this retracted configuration. This becomes important when there is a need to transport the crane and stow the crane swing warning system. At the further most end of the extendible section 25 of the retractable arm, generally represented as 21, a stiff but pliable ring 28 soft enough not to cause injury or damage if it should strike someone, is attached by means of a threaded bolt 29 and locking nut 30. This pliable ring 28 is used to support the caution tape that encompasses the swing radius of the cranes upper cab body 12, providing the warning of impending danger. The caution tape 31 is dispensed from a tape dispenser bracket 32 mounted to the projection leg 19 by means of a pair of spring clips 33. The tape dispenser bracket positively secures the roll of caution tape 31, by means of a carriage bolt 34 and nut 35. All components of the inventive crane swing warning device are coated with a highly visible fluorescent paint to increase and create a heightened awareness.

From the foregoing the advantages become subsequently apparent that the inventive crane swing warning system is extremely simple to install and remove, or stow, infinitesimally adjustable to fit any crane specification, economically manufactured and most importantly, as noted by the Department of Labor, provides effective warning of the impending danger produced by the movement of the parts relative to a crane especially those out of vision of the person operating same.

What is claimed as new is:

1. In a crane which has an undercarriage which is stationary as it relates to an upper body that rotates around a substantially vertical axis in order to move certain objects from one location to another vertically and/or horizontally, the improvement is as follows: caution tape, support means for suspending the caution tape completely surrounding the rotating superstructure of the upper crane body with spatial relation extending past the undercarriage wherein the support means comprises an arm with a magnetic base capable of support the arm when attached to the crane.

2. The improvement defined in claim 1 wherein support means for the caution tape further comprises the arm being retractable and consisting of a projection leg connected by a locking angle bracket to the tubular magnetic base and an extendible section, and, a pliable ring that retains and supports the continuous length of caution tape suspended around a crane swing radius from one support to the other.

* * * * *